US005417200A

United States Patent [19]

Wasielewski

[11] Patent Number: 5,417,200

[45] Date of Patent: May 23, 1995

[54] LANTERN COOKER

[76] Inventor: John J. Wasielewski, 4680 W. Cold Spring Rd., Greenfield, Wis. 53220

[21] Appl. No.: 186,683

[22] Filed: Jan. 25, 1994

[51] Int. Cl.[6] ..... F24C 5/04

[52] U.S. Cl. ..... 126/258; 126/209; 126/232; 126/235

[58] Field of Search ..... 126/258, 209, 232, 235, 126/282, 267; 362/312, 313, 174

[56] References Cited

U.S. PATENT DOCUMENTS

| | | | |
|---|---|---|---|
| 36,584 | 9/1862 | Greene | 126/258 |
| 71,651 | 12/1867 | Schartau . | |
| 246,950 | 9/1881 | Harcum | 362/313 |
| 752,503 | 2/1904 | Zimmerman | 126/258 |
| 1,007,461 | 10/1911 | Lehmann . | |
| 1,180,175 | 4/1916 | Moreton | 362/313 X |
| 2,448,326 | 8/1948 | Roberts | 126/258 |
| 2,502,389 | 3/1950 | Pastoret | 126/209 X |
| 2,583,916 | 1/1951 | Wickman | 126/256 |
| 2,638,085 | 5/1953 | Guedon | 126/40 |
| 3,133,536 | 3/1961 | Knapp | 126/258 |
| 3,408,998 | 11/1968 | Brancato et al. | 126/4 |
| 3,804,075 | 4/1974 | Rummel | 126/258 |
| 4,029,079 | 6/1977 | Elder | 126/258 |
| 4,091,795 | 5/1978 | Wells | 126/258 |
| 4,372,198 | 2/1983 | Stover, Jr. et al. | 99/340 |
| 4,572,157 | 2/1986 | Napier | 126/258 |

*Primary Examiner*—Larry Jones
*Attorney, Agent, or Firm*—Nilles & Nilles

[57] ABSTRACT

A lantern hood can be inverted from an upright, light reflecting position in which it permits the lantern to be used as a lighting device to an inverted position in which it is usable as a support for cooking utensils and permits the lantern to be used as a stove. The hood includes a lid having apertures formed therethrough which can be opened when the hood is used as a cooker and closed when the hood is used as a reflector. The hood also preferably includes a cooking cylinder shaped so as to support standard sized camping utensils when the hood is inverted, and springs for pulling the globe of the lantern into contact with the inverted hood to channel the heat from the lantern through the cooking cylinder, thereby enhancing the hood's operation as a cooker.

19 Claims, 3 Drawing Sheets

LANTERN COOKER

BACKGROUND OF THE INVENTION

1. Field of the Invention

The invention relates to lanterns and, more particularly, relates to a lantern which is convertible for use as either an illuminating device or as a stove for cooking or reheating food, and to a hood usable with such a lantern and permitting such conversion.

2. Background of the Invention

Portable stoves are often used by campers or hikers to cook or reheat food or drinks. Such stoves work well but are relatively bulky and may be undesirably large or heavy to carry, particularly when they must be carried along with lanterns and other camping or hiking equipment.

Proposals have been made to eliminate camping stoves by using the heat from lanterns to cook or reheat food. Devices heretofore proposed for this purpose may be divided into two categories, namely: (1) those which are designed as a replacement for or as an attachment to the stock hood of a lantern, which operate efficiently only when the lantern is used as a stove, and which should be replaced or removed when the lantern is used for lighting purposes, and (2) those which are designed to be used on the lantern for both lighting and cooking purposes. All known devices of both types exhibit marked drawbacks and disadvantages.

Examples of cooking devices designed to replace stock lantern hoods or to be attached to such stock hoods are disclosed in U.S. Pat. Nos. 3,408,998 to Brancato et al (the Brancato patent), 3,804,075 to Rummel (the Rummel patent) and 4,372,198 to Stover, Jr. et al (the Stover patent). The Rummel and Brancato patents each disclose a hood which is designed to replace the stock lantern hood and which is usable to cook foods. The Stover patent discloses a hot plate that is placeable over the existing lantern hood in order to use the lantern heat for cooking foods.

While all of these devices obviate the need to carry separate stoves and lanterns while camping or hiking, each presents disadvantages. For instance, the hot plate of Stover must be carried with the unmodified lantern in either its attached or its detached state and thus necessarily increases the weight and size of the lantern, thus rendering it less than ideally suitable for hiking or camping. This hot plate also is not dimensioned to receive standard cooking utensils sold for use with camping stoves. The hoods of both Rummel and Brancato function adequately as a stove but cannot be converted for use as a reflector. Ideal use of both devices thus requires that both the cooking hood and the stock reflecting hood be carried along on a hiking or camping expedition. Rummel recognizes this disadvantage and states that the reflecting hood may be left at home and that the cooking hood be used in its place. However, since this hood is not very well suited for use as a reflector and cannot be converted for such use, the advisability of such a practice would appear questionable.

Devices of the second type (those designed for use either as a reflector or as a cooker) are disclosed in U.S. Pat. Nos. 2,638,085 to Guedon (the Guedon patent) and 4,572,157 to Napier (the Napier patent). Both of these devices offer the advantage of not requiring separate reflecting and cooking hoods to be carried while camping or hiking. However, both of these devices, like that of Rummel, present essentially the same configuration when used as a cooker or reflector and thus are less than ideally suited for use as a either a reflector or as a cooker. Both are relatively complex to manufacture and to install, and the device of the Guedon patent offers the additional disadvantage of requiring the use of the hood in conjunction with a specially designed lantern.

OBJECTS AND SUMMARY OF THE INVENTION

It is therefore an object of the invention to provide a lantern hood which is convertible from a first state in which it works well as a reflector to a second state in which it works well as a cooker.

Another object of the invention is to provide a hood of the type described above which can permanently replace a stock lantern hood and which obviates the need to carry additional equipment along on camping or hiking trips.

Still another object of the invention is to provide a lantern hood of the type described above which is simple and relatively inexpensive to manufacture.

In accordance with a first aspect of the invention, these objects are achieved by providing a lantern hood having apertures formed therein for the passage of heat, and means for mounting the hood on a lantern in both an upright position in which the hood is usable as a reflector, and an inverted position in which the hood is usable as a food cooker.

The means for mounting may include a thumbnut or the like, and a resilient device may be provided for clamping the hood to a globe of the lantern and for pulling the globe into contact with the hood when the hood is used as a cooker.

Preferably, the hood includes a lid having the apertures formed therethrough, and a cooking cylinder on which the lid is mounted. The cooking cylinder rests on the lantern when the hood is in the upright position and forms a support for cooking utensils when the hood is in the inverted position.

Means are preferably provided for selectively closing the apertures in the hood. Such means may include a shutter which is rotatably mounted on the hood, the shutter comprising a plurality of fingers radiating from a central hub. Alternatively, such means may include a shutter which 1) is rotatably mounted on the lid and 2) has the same dimensions as the lid and apertures formed therein complimenting those of the lid.

Yet another object of the invention is to provide a lantern having a hood having at least some of the attributes discussed above.

In accordance with another aspect of the invention, this object is achieved by providing a lantern comprising a globe, a mantle encased by the globe, a hood support structure extending above the globe, and a hood. The hood includes a lid having apertures formed therein for the passage of heat, and means for mounting the lid on a lantern in both an upright position in which the hood is usable as a reflector, and an inverted position in which the hood is usable as a food cooker.

Preferably, the lantern comes with a carrying case having a base for supporting a base of the lantern during transport, a cavity being formed between the lantern base and the carrying case base for the storage of the spring.

Yet another object of the invention is to provide a method of quickly and easily converting a lantern from a first state in which it is usable as a lighting device to a second state in which it is usable as a stove.

In accordance with another aspect of the invention, this object is achieved be providing a method including the steps of converting a hood of a lantern from a first state in which the hood is designed for use as a reflector to a second state in which the hood is designed for use as a food cooker. The converting step preferably comprises at least one of opening apertures formed in the hood, inverting the hood, and lifting a globe of the lantern into contact with the hood and holding the globe in its lifted position.

Other objects, features, and advantages of the present invention will become apparent to those skilled in the art from the following detailed description and accompanying drawings. It should be understood, however, that the detailed description and specific examples, while indicating preferred embodiments of the invention, are given by way of illustration and not of limitation. Many changes and modifications may be made within the scope of the invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

1. Resume

Figure 3:
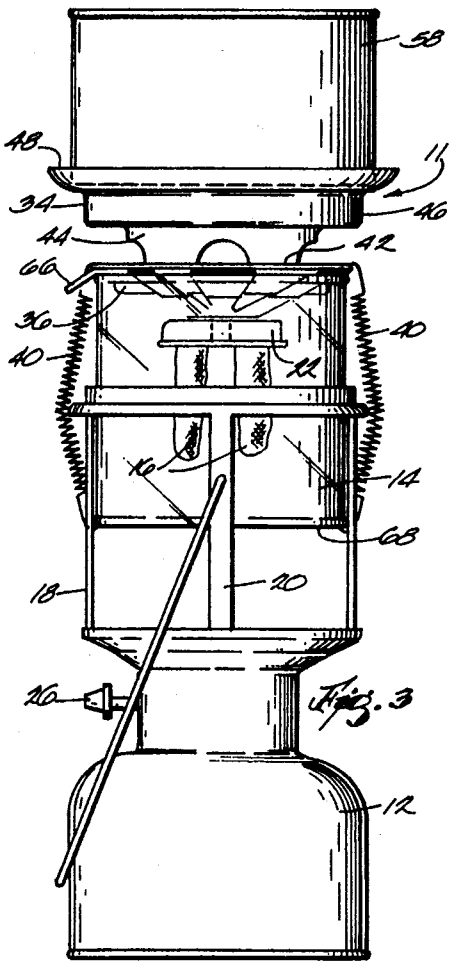
FIG. 3 is a side elevation view of the lantern of FIG. 1 with the hood inverted and being used as a cooker.
Figure 2:
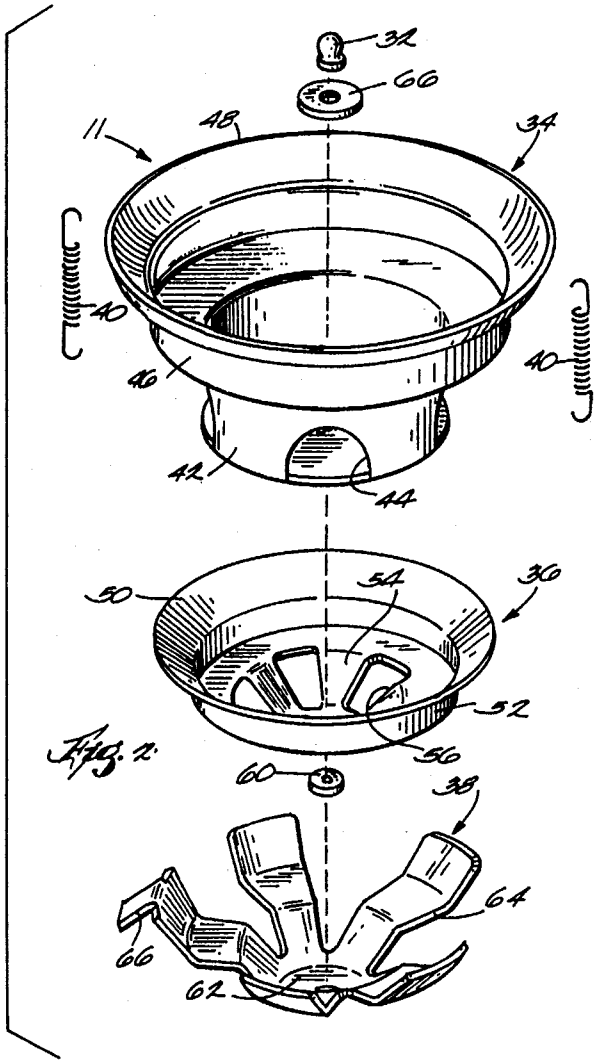
FIG. 2 is an exploded perspective view of the hood of FIG. 1 after it is inverted for use as a cooker for a stove formed by the lantern.

Pursuant to the invention, a lantern hood is provided which can be inverted from an upright, light reflecting position in which it permits the lantern to be used as a lighting device to an inverted position in which it is usable as a support for cooking utensils and permits the lantern to be used as a stove. The hood includes a lid having apertures formed therethrough which can be opened when the hood is used as a cooker and closed when the hood is used as a reflector. The hood also preferably includes a cooking cylinder shaped so as to support standard sized camping utensils when the hood is inverted, and springs for pulling the globe of the lantern into contact with the inverted hood to channel the heat from the lantern through the cooking cylinder, thereby enhancing the hood's operation as a cooker.

2. Construction and Operation of the First Embodiment

Referring now to FIGS. 1–5, a standard mantel-type lantern 10 is illustrated on which is supported a hood 11 constructed in accordance with a first preferred embodiment of the invention. Lantern 10 has a base 12, a glass globe 14 supported on the base 12, and a plurality (2 in the illustrated example) of mantels 16. The base 12 serves as a fuel reservoir and also supports a frame 18 which slidably receives the globe 14. A fuel supply line/support tube 20 extends upwardly from an axially central portion of the base 12 and terminates in an inverted cup 22 from which are suspended the mantels 16. A threaded post 24 extends upwardly from the cup 22 for receiving the hood 11 as detailed below. Operation of the lantern 10 is controlled by a rotatable knob 26. The lantern 10 comes with a carrying case the base 28 of which receives the bottom of the base 12 of lantern 10 with a cavity 30 formed therebetween. The lantern 10 as thus far described is conventional and, accordingly, will not be described in further detail.

The hood 11 is designed to replace the stock hood supplied with the lantern 10 and to be mounted on the lantern using the same threaded post 24 and associated thumb nut 32 used to attach the stock hood to the lantern 10. The hood 11 is preferably designed to be invertible from the upright position illustrated in FIG. 1 in which it operates efficiently as a reflector and permits the lantern 10 to operate as a lighting device to the inverted position illustrated in FIGS. 2–5 in which hood 11 operates efficiently as a support for cooking utensils and permits the lantern 10 to operate as a stove or cooker. To this end, the hood 11 preferably comprises a generally cylindrical cooking cylinder 34, a lid 36 affixed to the cooking cylinder 34, and a shutter 38 slidably attached to the lid 36. A pair of springs 40 are used only when the hood 11 is used as a cooker and are otherwise stored in a convenient location.

The cooking cylinder 34 and lid 36 are preferably formed from stamped sheet metal and are affixed to one another, e.g., by spot welding. Cooking cylinder 34 has a generally cylindrical reduced diameter portion 42 presenting standard exhaust or vent holes 44, an intermediate cylindrical portion 46 of increased diameter, and a still larger flared skirt 48 for encircling the upper portion of the globe 14 when the hood 11 is used as a cooker. Lid 36 has a skirt 50, an intermediate generally cylindrical portion 52 for receiving the smaller cylindrical portion 42 of the cooking cylinder 34, and a generally frusto-conical end portion 54.

Both the cooking cylinder 34 and lid 36 are specially designed to facilitate the use of the hood 11 as a cooker. Most notably, the end portion 54 of the lid 36 has a plurality of apertures 56 formed therethrough for the selective passage of heated air and radiant heat, and the intermediate and end portions 46 and 48 of the cooking cylinder 34 are specially dimensioned so as to receive standard cooking utensils such as a pan 58 illustrated in FIGS. 3 and 4. The end portion or skirt 50 of the lid 36 is also slightly upturned so as to facilitate the attachment of the springs 40 to the lid 36 for reasons detailed below.

Shutter 38 is designed to regulate the effective size of the apertures 56 in the lid 36, thus regulating the passage of heat through the lid 36. To this end, the shutter 38 is attached to the lid 36 by a grommet 60 so as to be rotatable with respect to the lid 36 to selectively partially or completely cover the apertures 56. Shutter 38 is formed from stamped sheet metal, has a central hub 62, a plurality of fingers 64 extending radially from the central hub 62 and shaped so as to complement the shape of the lid 36, and a tab 66 which can be manipulated so as to permit rotation of the shutter 38 with respect to the lid 36.

Figure 1:
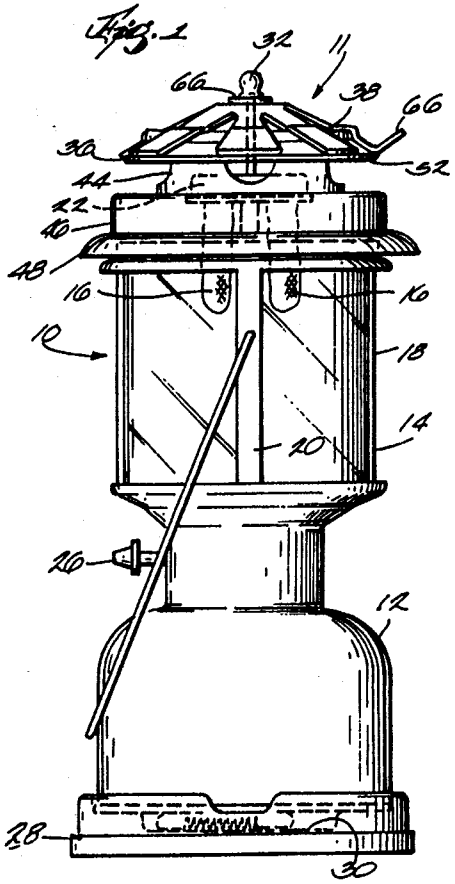
FIG. 1 is a side elevation view of a lantern having a hood which is constructed in accordance with a first preferred embodiment of the invention and which is mounted on the lantern in its upright, reflecting position.
Figure 5:
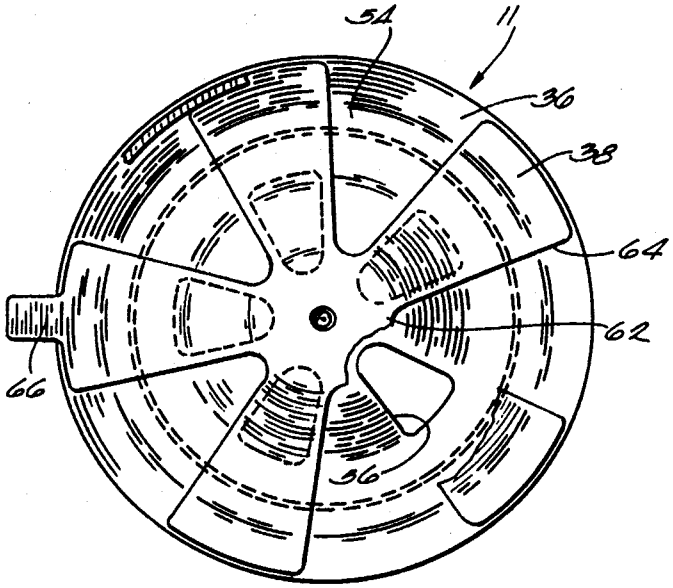
FIG. 5 is a sectional view taken along the lines 5—5 in FIG. 4.

To prepare the lantern 10 for use as a standard illuminating device, the hood normally supplied by the manufacturer is replaced either by the manufacturer or by the consumer with the hood 11 by bolting the hood 11 to the lantern 10 in the position illustrated in FIG. 1 using the thumb nut 32 and a washer 66. The cooking cylinder 34 thus rests upon the top of the globe 14 with its skirt 48 encircling the upper portion of the globe. Springs 40 are not required when the hood 11 is used in this manner and can be stored at any convenient location, such as in the cavity 30 defined between the bottom of the reservoir 12 and the storage case base 28.

The lantern is then lit in a manner known to those skilled in the art and adjusted by operation of knob 26. The skirt 48 of cooking cylinder 34 reflects light and heat and enhances use of the lantern 10 as an illuminating device. Heated air rising out of the hood 11 through exhaust holes 44 is reflected and dissipated by the lid 36, the apertures 56 of which should be closed by prior manipulation of shutter 38.

Figure 4:
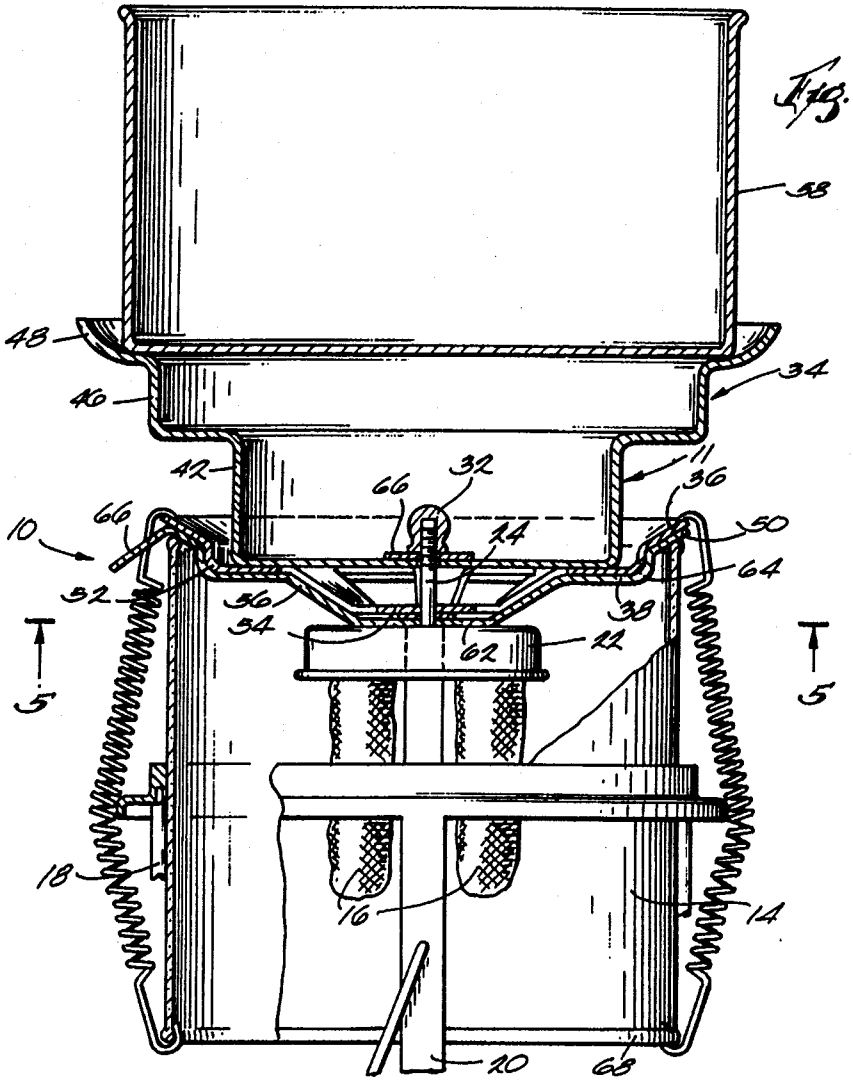
FIG. 4 is a sectional elevation view of the lantern and upper portion of the hood when the hood is in the inverted position illustrated in FIG. 3.

To ready the lantern 10 for use a stove, the thumb nut 32 and the associated washer 66 are removed and the hood 11 is removed, inverted, and replaced such that the lid 36 rests on the lantern 10 as illustrated in FIGS. 3 and 4. The thumb nut 32 and washer 66 are then replaced, and the springs 40 are attached to the lip of the skirt 50 of the lid 36 and to a bottom lip 68 of the globe 14 so as to pull the globe 14 up into contact with the lid 36 as illustrated in FIG. 4 and so as to help clamp the hood 11 in position. The shutter 38 is then opened by manipulating the tab 66 to open the apertures 56 in lid 36, the mantels 16 are lit, and a cooking utensil, such as the pan 58 is placed on the inverted cooking cylinder 34. Depending on its diameter, the pan 58 may rest on the skirt 48 of cooking cylinder 34 as illustrated or on the base of intermediate cylindrical portion 46.

Radiant heat and heated air from mantels 16 are prevented from flowing directly away from the cooking cylinder 34 by the generally sealing engagement of the globe 14 on the lid 36. Heat from the mantels 16 is thus directed through the apertures 56 in the lid 36 and either 1) through the exhaust holes 44 in the cooking cylinder 34 and to the bottom of the pan 58, thus directly heating the pan 58, and/or 2) around the intermediate cylindrical portion 46 and skirt 48 of the cooking cylinder 34, thus heating the cooking cylinder 34 which in turn heats the pan 58. In either event, substantially all of the heat is ultimately directed to the pan 58. The degree of heat provided can be regulated by adjustment of the standard lantern control knob 26 and/or by manipulating the tab 66 on shutter 38 to vary the effective size of the apertures 56. When cooking is complete, the lantern 10 is turned off by operation of knob 26, and the apertures 56 are closed by rotation of shutter 38 as to prevent the transfer of further heat to the pan 58.

It can thus be seen that the inventive hood 11 operates efficiently as both a reflector and as a support for cooking utensils and permits the lantern 10 to be used either as a lighting device or a stove or cooker, obviates the need to carry any other stove or stove adapters with the lantern, and is quickly and easily convertible from its reflecting position to its cooking position.

The hood 11 is also simple to manufacture and can be made entirely from stamped sheet metal parts. Assembly is also very simple and only requires (1) the welding or other suitable attachment of the lid 36 to the cooking cylinder 34, and (2) the connection of the shutter 38 to the lid 36 by the simple grommet 60 or any other device enabling relative rotation. Manufacturing can be facilitated still further by replacing the shutter 38 with a device having a shape conforming more closely to that of the lid 36. Once such alternative construction will now be described.

3. Construction and Operation of Second Embodiment

Figure 6:
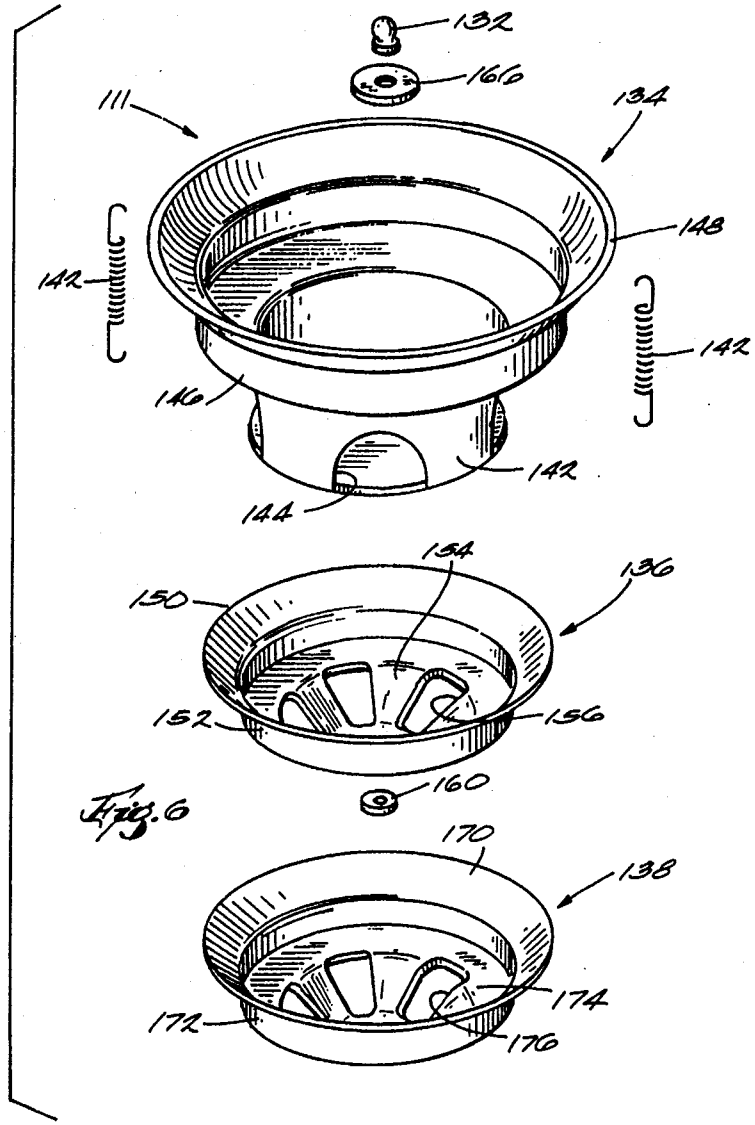
FIG. 6 is an exploded perspective view of a lantern hood constructed in accordance with a second preferred embodiment of the invention.

Referring now to FIG. 6, a hood 111 is illustrated which is usable with the lantern 10 of FIGS. 1 and 4 and which is for the most part identical in construction and operation to the hood 11 of FIGS. 1–5. Elements of hood 111 corresponding to those of hood 11 of FIGS. 1–5 are designated by the same reference numerals, incremented by 100. Hood 111 thus includes a stamped metal cooking cylinder 134, a stamped metal lid 136 spot welded or otherwise affixed to the cooking cylinder 134, and a shutter 138 rotatably connected to the lid 136 by a grommet 160 or the like.

The hood 111 of FIG. 6 differs from the hood 11 of FIGS. 1–5 primarily in that the shutter 138 is essentially identical in shape to the lid 136 and, in fact, can be formed from the same stamping machine and out of the same sheet metal material used to manufacture the lid 136, thereby significantly reducing production costs. The shutter thus includes a skirt 170 having a short up-turned flange, an intermediate generally cylindrical portion 172, and a generally frusto-conical end portion 174 having a plurality of apertures 176 formed therethrough. The passage of heat through the apertures 156 of lid 136 can be regulated by selective rotation of the shutter 138 with respect to the lid 136 to vary the effective size of apertures 156. The construction and operation of hood 111 are otherwise identical to those of the hood 11 of the first embodiment and thus will not be described in more detail.

As can be readily observed from FIG. 6, shutter 138 offers the advantages of presenting a slightly better surface for engagement with the top of the globe 14 and also appears more sturdy than the finger-type shutter of the first embodiment. Moreover, manufacturing costs are significantly reduced since, as discussed above, the same stamping machine can be used to manufacture the shutter 138 and the lid 136.

Many changes and modifications could be made to the invention as described above without departing from the spirit thereof. The scope of such changes will become apparent from the appended claims.

I claim:

1. An apparatus comprising:

A. a lantern hood having apertures formed therein for the passage of heat; and

B. means for mounting said hood on a lantern in both (1) an upright position in which said hood is usable as a reflector; and (2) an inverted position in which said hood is usable as a support for cooking utensils, wherein said hood includes (A) a lid having said apertures formed therethrough, and (B) a cooking cylinder on which said lid is mounted, said cooking cylinder resting on said lantern when said hood is in said upright position and forming said support for cooking utensils when said hood is in said inverted position.

2. An apparatus as defined in claim 1, further comprising a resilient device for clamping said hood to a globe of said lantern and for pulling said globe into contact with said hood when said hood is used as a support for cooking utensils.

3. An apparatus as defined in claim 1, wherein said cooking cylinder has a reduced diameter portion with exhaust holes formed therein, and an increased diameter portion forming a support surface for said cooking utensils.

4. An apparatus as defined in claim 1, further comprising means for selectively closing said apertures in said lid.

5. An apparatus as defined in claim 4, wherein said means for selectively closing comprises a shutter which is rotatably mounted on said lid, said shutter comprising a plurality of fingers radiating from a central hub.

6. An apparatus as defined in claim 4, wherein said means for selectively closing comprises a shutter which is rotatably mounted on said lid, said shutter having the same dimensions as said lid and having apertures formed therein complimenting those of said lid.

7. An apparatus as defined in claim 1, wherein said means for mounting comprises a thumbnut.

8. An apparatus comprising:

A. a lantern hood which is mountable on a lantern and which has apertures formed therein for the passage of heat, said hood being invertible from an upright position in which it is usable as a reflector to an inverted position in which it is capable of receiving cooking utensils; wherein said hood includes (1) a lid having said apertures formed therethrough, and (2) a cooking cylinder on which said lid is mounted, said cooking cylinder resting on said lantern when said hood is in said upright position and forming a support for said cooking utensils when said hood is in said inverted position; and B. means for selectively closing said apertures to selectively prevent the flow of heated air through said hood.

9. An apparatus as defined in claim 8, wherein said means for selectively closing comprises a shutter rotatably mounted on said hood.

10. An apparatus as defined in claim 8, further comprising means for mounting said hood on a lantern in both (1) said upright position; and (2) said inverted position.

11. A lantern comprising:

A. a globe;

B. a mantle encased by said globe;

C. a hood support structure extending above said globe;

D. a hood comprising (1) a lid having apertures formed therein for the passage of heat; and (2) means for mounting said lid on a lantern in both (A) an upright position in which said hood is usable as a reflector; and (B) an inverted position in which said hood is usable as a support for cooking utensils, wherein said hood further comprises a cooking cylinder on which said lid is mounted and which is invertible with said lid, said cooking cylinder resting on said lantern when said lid is in said upright position and forming said support for cooking utensils when said lid is in said inverted position.

12. A lantern comprising:

A. a globe;

B. a mantle encased by said globe;

C. a hood support structure extending above said globe;

D. a hood comprising (1) a lid having apertures formed therein for the passage of heat;

(2) means for mounting said lid on a lantern in both (A) an upright position in which said hood is usable as a reflector;

(B) an inverted position in which said hood is usable as a support for cooking utensils; and (C) a spring for lifting said globe upwardly into contact with said lid when said hood is in said inverted position and for holding said globe in its lifted position.

13. A lantern as defined in claim 12, further comprising a carrying case base for supporting a base of said lantern during transport, a cavity being formed between said lantern base and said carrying case base for the storage of said spring.

14. An apparatus as defined in claim 11, further comprising means for selectively closing said apertures in said lid.

15. A lantern as defined in claim 11, wherein said means for mounting comprises a thumbnut.

16. A lantern comprising:

A. a globe;

B. a mantle encased by said globe;

C. a hood support structure extending above said globe;

D. a hood comprising (1) a lid having apertures formed therein for the passage of heat, (2) means for selectively closing said apertures, and (3) a cooking cylinder on which said lid is mounted; and E. means for mounting said hood on said hood support structure in both (A) an upright position in which said cooking cylinder rests on said globe and in which said hood is usable as a reflector, and (B) an inverted position in which said lid rests on said globe and in which said cooking cylinder forms a support for cooking utensils, said means for mounting including a spring which connects said lid to said globe when said hood is in said inverted position and which pulls said globe into contact with said lid.

17. A method comprising:

A. providing a lantern having a globe and a hood; then

B. inverting said hood from a first position in which said hood is designed for use as a reflector to a second position in which said hood is designed for use as a support for cooking utensils; and then C. lifting said globe into contact with said hood and holding said globe in its lifted position.

18. A method as defined in claim 17, wherein said providing step comprises providing a hood having apertures formed therein and said converting step comprises opening said apertures.

19. An apparatus comprising:

a lantern hood which is mountable on a lantern and which has apertures formed therein for the passage of heat, said hood being invertible from an upright position in which it is usable as a reflector to an inverted position in which it is capable of receiving cooking utensils; wherein said hood includes (1) a lid having said apertures formed therethrough, and (2) a cooking cylinder on which said lid is mounted, said cooking cylinder resting on said lantern when said hood is in said upright position and forming a support for cooking utensils when said hood is in said inverted position.

* * * * *